US010383495B2

(12) United States Patent
Mundinger et al.

(10) Patent No.: US 10,383,495 B2
(45) Date of Patent: Aug. 20, 2019

(54) CLEANING TOOL FOR A FLOOR CLEANING MACHINE AND A FLOOR CLEANING MACHINE

(71) Applicant: Alfred Kärcher GmbH & Co. KG, Winnenden (DE)

(72) Inventors: Tobias Mundinger, Malterdingen (DE); Eugen Class, Murrhardt (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 437 days.

(21) Appl. No.: 15/065,131

(22) Filed: Mar. 9, 2016

(65) Prior Publication Data

US 2016/0183755 A1 Jun. 30, 2016

Related U.S. Application Data

(63) Continuation of application No. PCT/EP2013/069032, filed on Sep. 13, 2013.

(51) Int. Cl.

| | |
|---|---|
| ***A47L 11/162*** | (2006.01) |
| ***A47L 11/283*** | (2006.01) |
| ***A47L 11/40*** | (2006.01) |

(52) U.S. Cl.

CPC ..... *A47L 11/283* (2013.01); *A47L 11/162* (2013.01); *A47L 11/4038* (2013.01); *A47L 11/4052* (2013.01); *A47L 11/4069* (2013.01)

(58) Field of Classification Search

CPC .. A47L 11/283; A47L 11/162; A47L 11/4038; A47L 11/4052; A47L 11/4069

See application file for complete search history.

(56) References Cited

U.S. PATENT DOCUMENTS

| | | | | |
|---|---|---|---|---|
| 3,600,735 | A * | 8/1971 | Jerabek | A47L 11/164 15/159.1 |
| 4,866,804 | A | 9/1989 | Masbruch et al. | |
| 5,421,053 | A | 6/1995 | Chodak | |
| 5,875,506 | A * | 3/1999 | Plazanet | A47L 11/03 15/230 |
| 6,059,493 | A | 5/2000 | Kim et al. | |
| 6,391,414 | B1 | 5/2002 | Hjertman et al. | |
| 7,587,779 | B2 | 9/2009 | Walz et al. | |
| 8,894,773 | B2 | 11/2014 | Riach et al. | |
| 9,265,397 | B2 * | 2/2016 | Larson | A47L 11/283 |
| 2011/0155488 | A1 | 6/2011 | Riach | |

FOREIGN PATENT DOCUMENTS

| | | |
|---|---|---|
| EP | 0 251 987 | 1/1988 |
| EP | 1 279 363 | 1/2003 |

* cited by examiner

*Primary Examiner* — Randall E Chin

(74) *Attorney, Agent, or Firm* — Womble Bond Dickinson (US) LLP

(57) ABSTRACT

A cleaning tool for a floor cleaning machine is proposed which includes a cleaning-action device and a supporting part on which the cleaning-action device is arranged and by means of which the cleaning tool is fixable to the floor cleaning machine, wherein the supporting part includes a seating having a wall and a seating space for a tool holding head of the floor cleaning machine which is bounded by the wall, and the wall includes a holding region for the tool holding head, wherein the wall includes an insertion region for the tool holding head to which the holding region is adjoined, wherein the seating space is widened in the insertion region in comparison with the holding region and tapers towards the holding region.

29 Claims, 6 Drawing Sheets

CLEANING TOOL FOR A FLOOR CLEANING MACHINE AND A FLOOR CLEANING MACHINE

CROSS-REFERENCE TO RELATED APPLICATIONS

This application is a continuation of international application number PCT/EP2013/069032 filed on Sep. 13, 2013, which is incorporated herein by reference in its entirety and for all purposes.

BACKGROUND OF THE INVENTION

The invention relates to a cleaning tool for a floor cleaning machine comprising a cleaning-action device and supporting part on which the cleaning-action device is arranged and by means of which the cleaning tool is fixable to the floor cleaning machine, wherein the supporting part comprises a seating having a wall and a seating space for a tool holding head of the floor cleaning machine which is bounded by the wall, and the wall comprises a holding region for the tool holding head.

Furthermore, the invention relates to a floor cleaning machine comprising at least one tool holding head.

From WO 2007/033719 A1, there is known a mobile floor cleaning machine having a rotatably driven, disk-shaped cleaning tool which is held in releasable manner on a tool holder that is connected in mutually non-rotatable manner to a drive shaft. The cleaning tool is latchable to the tool holder in releasable manner and is separable from the tool holder in the axial direction by means of a releasing mechanism that is operable by the user.

From EP 0 679 766 A2, there is known a coupling for fixing a brush to a rotatable shaft in releasable manner.

From EP 1 279 363 A1, there is known a device for attaching and/or for driving a brush body of a cleaning machine which comprises a substantially hollow-cylindrical seating element and an insertion element that is insertable therein, positive transmission of power being ensured by means of at least one projection and at least one corresponding recess.

From EP 0 251 987 A1, there is known a mobile floor cleaning machine having a rotatably driven driving tool which is attached in releasable manner to a tool holder that is coupled to a shaft of the drive motor. There is provided a locking element which is moveable between a release position and a locking position and which engages with a stop member on the tool holder in the locking position thereby preventing rotation of the tool holder and which is disengaged from the tool holder in the release position.

SUMMARY OF THE INVENTION

In accordance with the present invention, a cleaning tool is provided, which is fixable in a simple manner.

In accordance with an embodiment of the invention, the wall comprises an insertion region for the tool holding head to which the holding region is adjoined, wherein the seating space is widened in the insertion region in comparison with the holding region and tapers towards the holding region.

The process of inserting the tool holding head into the seating space is facilitated by the insertion region. There is more play available for the insertion process.

This is particularly advantageous if a lifting device by means of which the tool head is lowerable is associated with the tool holding head. The tool head can thereby be lowered for the purpose of inserting it into the seating space and the user has a greater amount of play for positioning the cleaning tool on a substrate for example in order to achieve the fixing action.

Due to the cleaning tool in accordance with the invention, replacement of a tool can be accomplished more quickly and more simply.

As a result of the tapering in the insertion region, there is also provided guidance for the tool head in order to enable the process of inserting it into the holding region to be effected in a simple manner.

In particular, the seating space tapers continuously in the insertion region in a direction towards the holding region in order to achieve a simple and rapid insertion process.

For the same reason, it is expedient if the seating space is of greater diameter in the insertion region than in the holding region. A greater amount of play for the process of inserting the tool holding head into the seating space can thereby be provided.

The insertion region is arranged in the seating space before the holding region taken with reference to an insertion direction of the tool holding head. The process of inserting the tool holding head into the seating space is thereby facilitated.

In one exemplary embodiment, a wall region which defines the insertion region is oriented at an obtuse angle to a wall region which defines the holding region. A sort of insertion funnel which simplifies the process of replacing a tool is thereby provided.

In particular, the obtuse angle lies in a range of between 120° and 160° and in particular, in a range of between 140° and 160°.

In one exemplary embodiment and with regard to an envelope thereof, an inner surface of the holding region facing the seating space is cylindrical. A coupling and in particular a mutually non-rotatable coupling can thereby be obtained in a simple manner when the tool holding head is arranged in the holding region.

Furthermore, it is expedient if, with regard to an envelope thereof, an inner surface of the insertion region facing the seating space is in the form of a frustum of a cone, wherein in particular, an axis of the cone coincides with the cylinder axis for an envelope of the holding region. The process of inserting the tool holding head into the seating space can thereby be facilitated in a simple manner.

It is expedient if the wall is in the form of a ring. This thereby results in a simple production process and greater mechanical rigidity, and rotation of the cleaning tool can be realized in a simple manner.

In one embodiment, the wall has a cylindrical outer surface. In particular, a shoulder is then formed between a flange and the cylindrical outer surface. The cleaning-action device can be fixed to this shoulder for example.

It is expedient if the supporting part extends in an axial direction with an axial axis which coincides with a rotational axis of the cleaning tool, wherein in particular, the axial direction is a direction of insertion for the tool holding head into the seating space. This thereby results in a simple compact structure.

Furthermore, it is expedient if one or more sub-regions of the wall protrude beyond a flange. The flange can be used for fixing the cleaning-action device for example. The flange could, for example, also be used for enabling a releasing mechanism to engage therewith in order to allow the cleaning tool to be detached from the tool holding head in a simple manner.

In one exemplary embodiment, a plurality of spaced ribs are arranged on an inner surface of the wall at least in the holding region, wherein a mating element of the tool holding head is insertable into a space between spaced ribs. A mutually non-rotatable fixing of the cleaning tool to the tool holding head can thereby be realized in a simple manner.

In particular, the ribs are oriented in an axial direction and are spaced in a circumferential direction. Furthermore, they extend in a radial direction.

It is expedient if the ribs have an upper surface which is oriented at an acute angle to an axial direction. Insertion of the tool holding head into the seating space can thereby be effected in a simple manner and furthermore, the introduction of a mating element into a space between neighboring ribs can also be achieved.

In particular, the upper surface is arranged at least partly in the insertion region. This thus results in greater rigidity of the supporting part and the insertion process is facilitated.

It is particularly advantageous if a rib comprises a tapering region towards a rib spaced therefrom wherein the width of the rib in the direction of spacing from the neighbouring rib reduces in a direction towards the insertion region. An insertion guidance arrangement for a mating element can thereby be realized in order to enable the mating element to be moved into the space between neighboring ribs in a simple manner.

For the same reason, it is expedient if a sloping surface serving as an insertion aid for a mating element of the tool holding head is formed in the tapering region. The sloping surface provides a sort of wedge surface for facilitating the insertion process into the space between neighboring ribs.

Expediently, a locating element for the tool holding head is arranged on the supporting part in an axial direction, said locating element being connected, in particular, to the wall in the holding region and being, in particular, in the form of a ring. The supporting part acts as a stop member for the tool holding head in order to prevent a "full penetration" through the seating space. A suitable axial stop member can be obtained, with minimal expenditure on material, by means of a locating element in the form of a ring.

It is expedient if at least one meshing element for the tool holding head is arranged on the supporting part for axial fixing purposes. Axial fixing of the cleaning tool in the tool holding head can thereby be obtained in a direction opposite to the direction of the stop member.

In one exemplary embodiment, the at least one meshing element is arranged on a locating element for the tool holding head. This thereby results in a constructively simple and material-saving structure for the supporting part.

For example, the at least one meshing element is positioned on the supporting part in moveable manner and is latchable to the tool holding head. The freedom of movement is attained by means of the self-elasticity of the meshing element for example. A sort of snap connection can thereby be realized. For example, automatic engagement can thereby be achieved when the tool holding head is inserted correspondingly into the seating space in the insertion direction. Furthermore, the release thereof can also be achieved in a simple manner.

It is technically expedient if the supporting part is formed in one piece manner.

In particular, the cleaning tool is a floor cleaning tool such as an e.g. brushing tool in the form of a scrubbing tool or a sweeping tool for example.

In accordance with the invention, there is provided a floor cleaning machine which comprises at least one tool holding head to which a cleaning tool in accordance with the invention is fixable or is fixed in releasable manner.

The floor cleaning machine in accordance with the invention exhibits the advantages that have already been described in connection with the cleaning tool in accordance with the invention.

In particular, the tool holding head is driven or is drivable in rotary manner. A cleaning process can thereby be accomplished in an effective manner.

It is expedient if the at least one tool holding head is moveable in a height direction taken with respect to a substrate on which the floor cleaning machine is placed. Replacement of a cleaning tool can be effected in a simple manner by appropriate travel of the tool holding head.

Advantageously, the at least one tool holding head has a plurality of spaced grooves on an outer surface thereof, wherein a respective mating element is formed between each of the neighboring grooves, and ribs of the supporting part of the cleaning tool are insertable into the grooves and the mating element is insertable into a space between neighboring ribs of the supporting part. Mutually non-rotatable fixing can thereby be achieved in a simple manner so that the cleaning tool will be rotated by the rotation of the tool holding head.

It is expedient if the at least one tool holding head comprises at least one recess for a meshing element of the cleaning tool for the purpose of the axial fixing thereof. Fixing can thereby be achieved in a simple manner.

In particular, the floor cleaning machine in accordance with the invention is a mobile floor cleaning machine. In operation hereby, it can be driven or the user's body power may be necessary for moving it. The floor cleaning machine in accordance with the invention is, for example, a sit-on machine or a walk-behind machine.

The following description of preferred embodiments taken in conjunction with the drawings serves to provide a more detailed explanation of the invention.

DETAILED DESCRIPTION OF THE INVENTION

Figure 1:
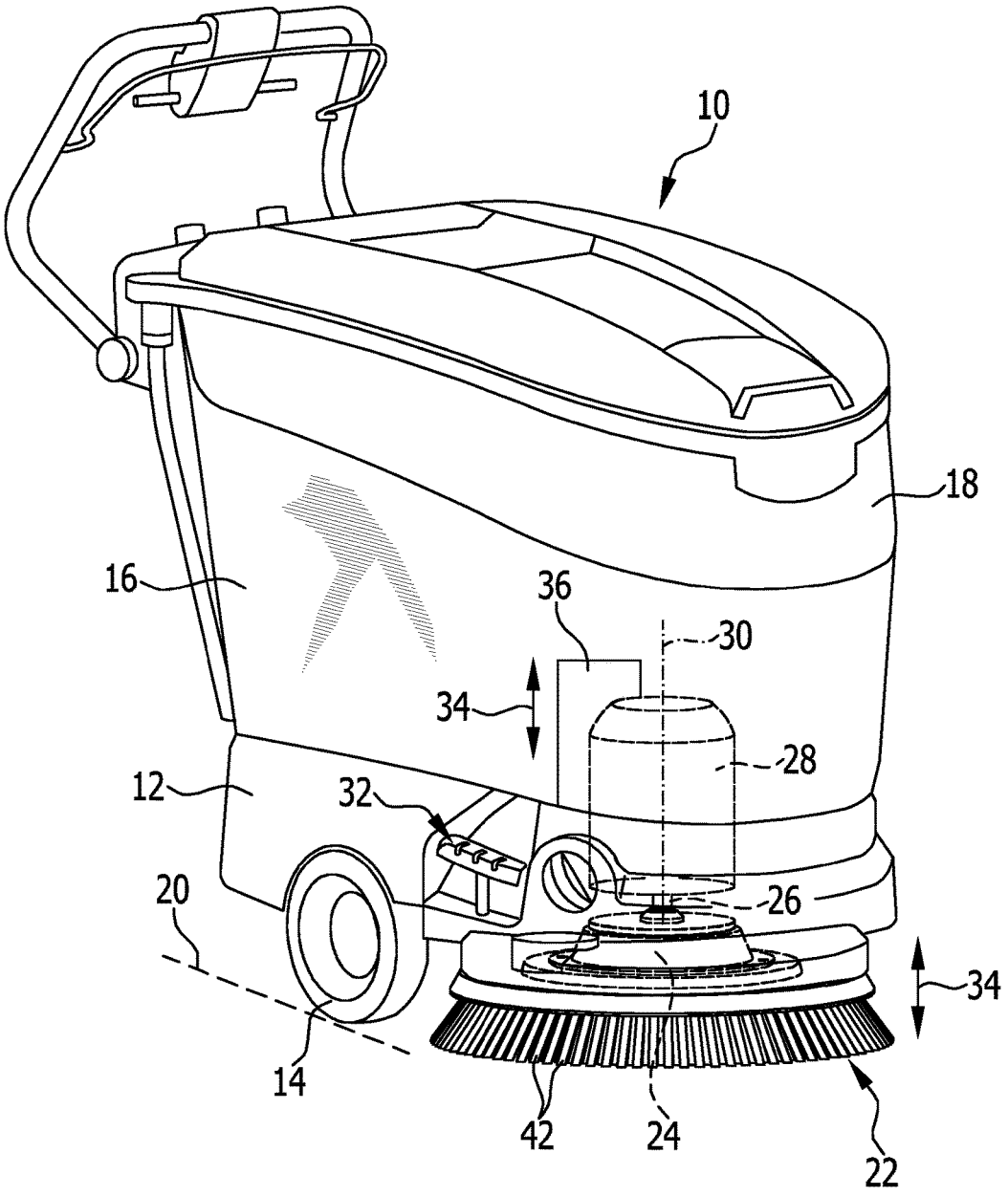
FIG. 1 shows a schematic illustration of an exemplary embodiment of a floor cleaning machine having a cleaning tool arranged thereon.
Figure 2:
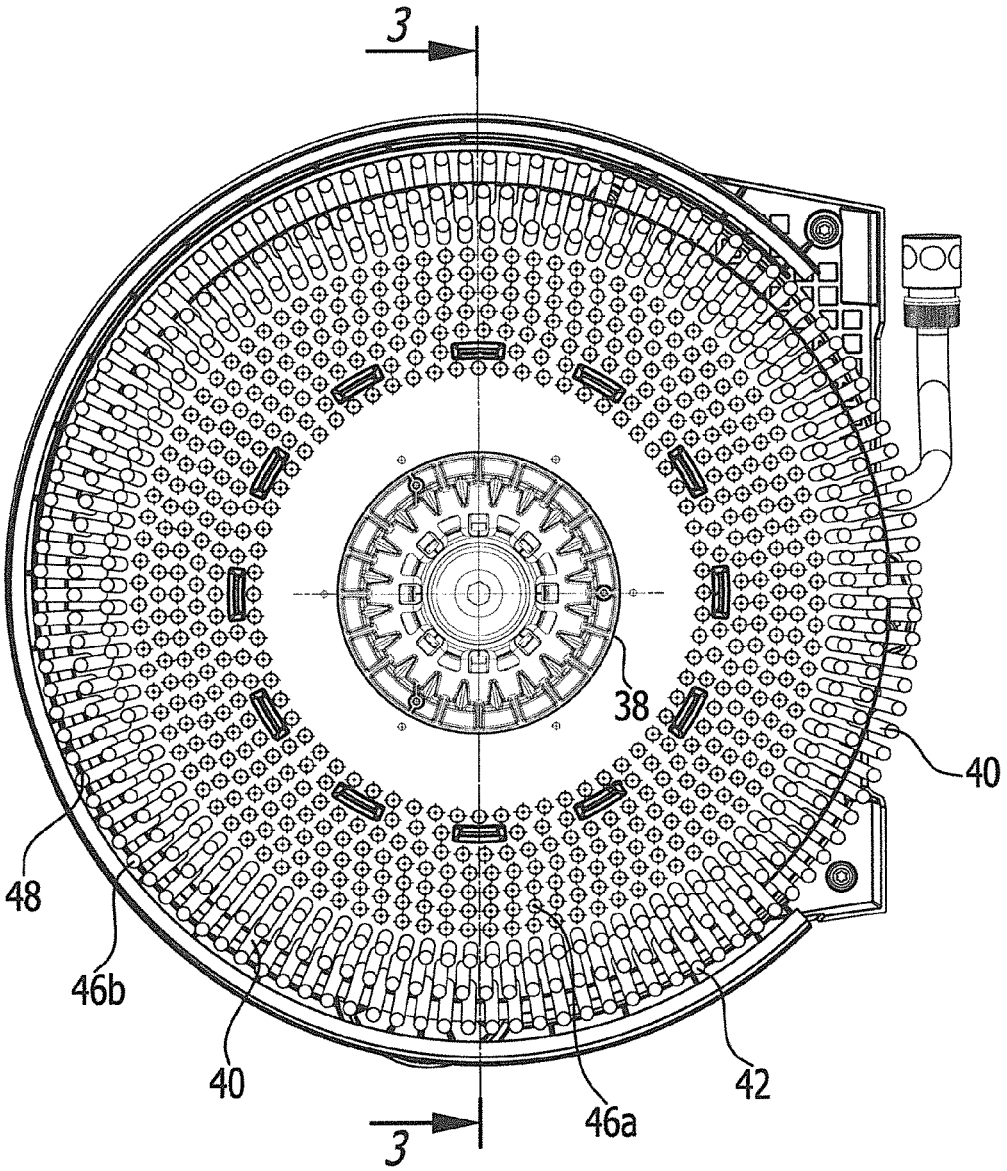
FIG. 2 shows a view from below of the cleaning machine in accordance with FIG. 1 in the region of the cleaning tool.
Figure 3:
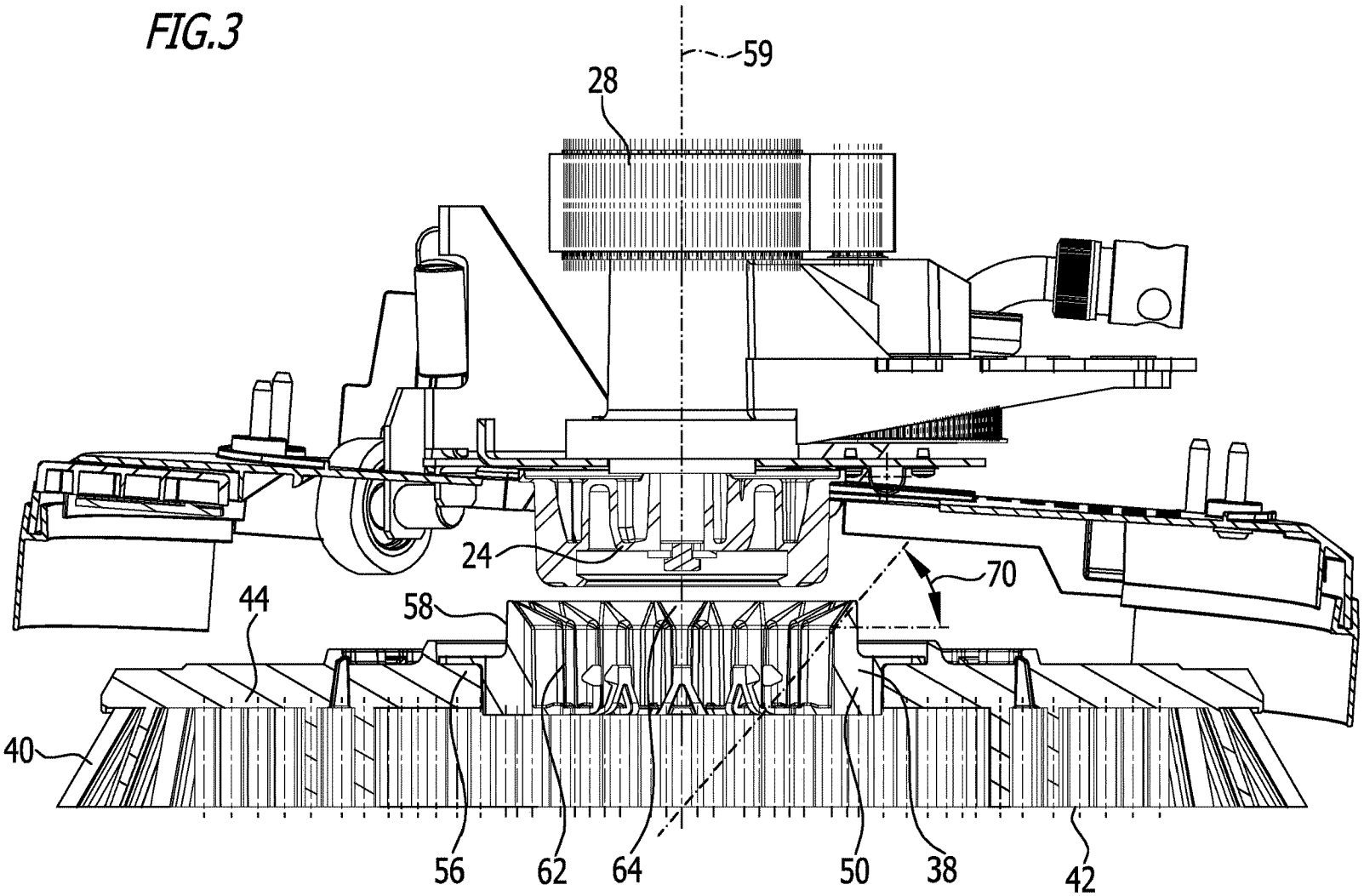
FIG. 3 shows a sectional view along the line 3-3 in accordance with FIG. 2.
Figure 4:
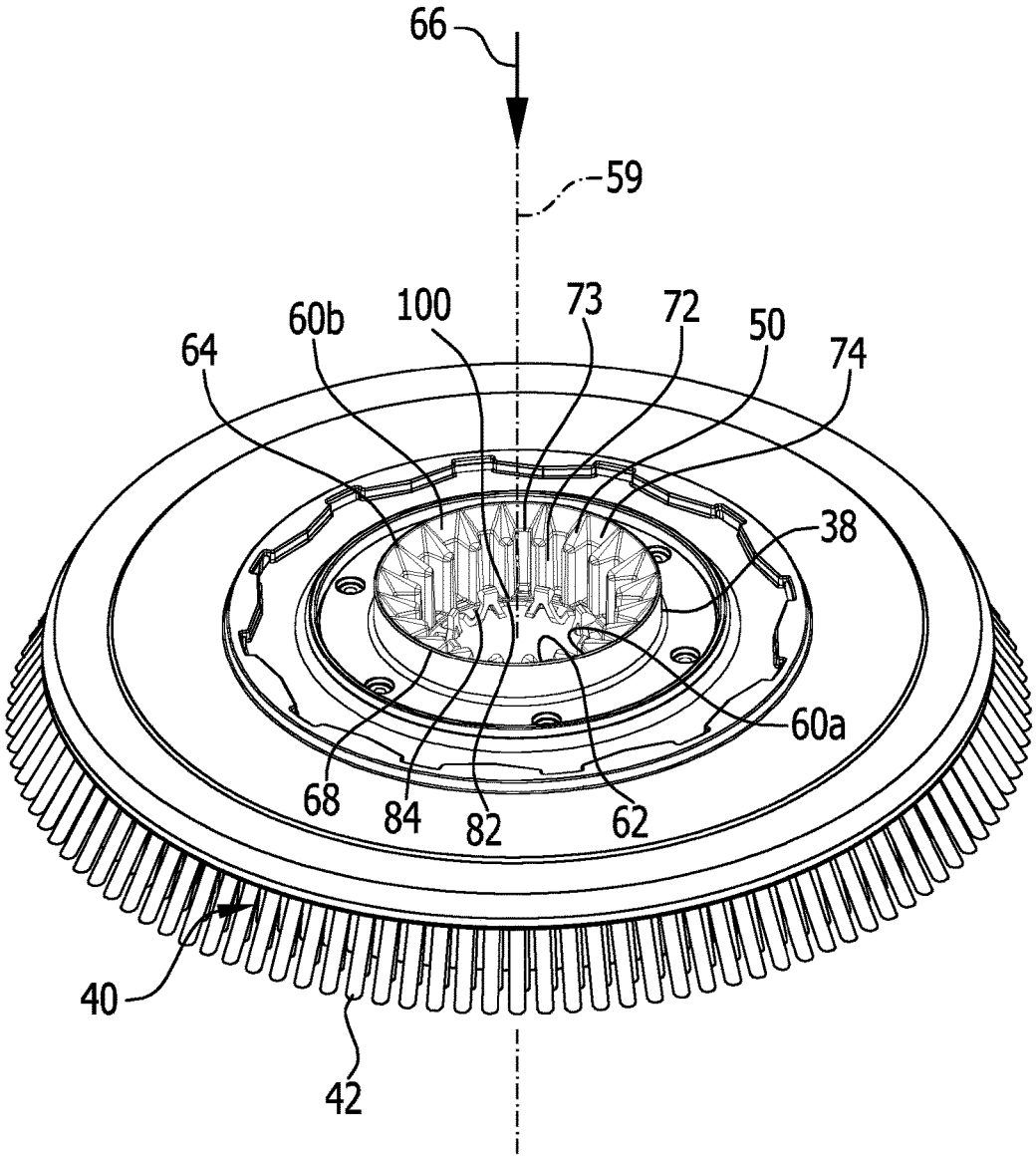
FIG. 4 shows a perspective illustration of an exemplary embodiment of a cleaning tool which is detached from the floor cleaning machine.
Figure 5:
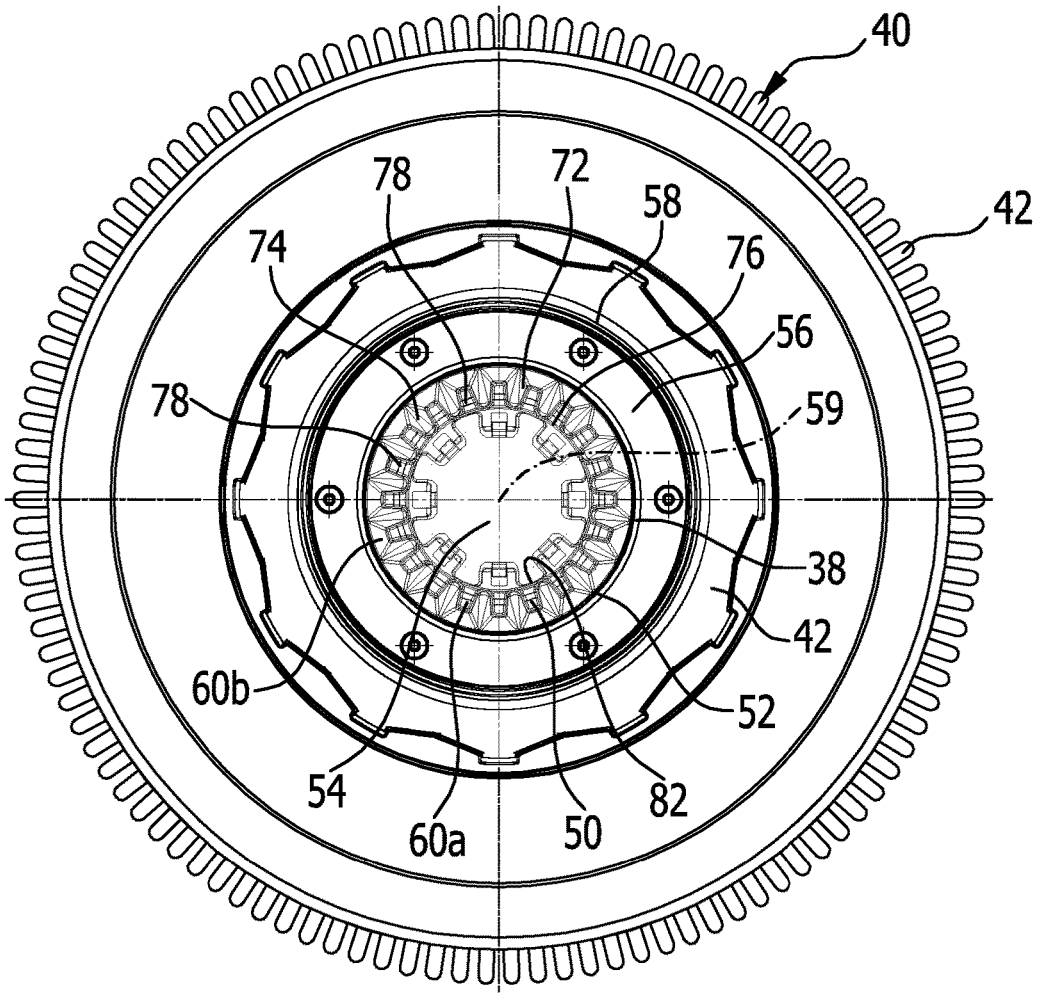
FIG. 5 shows a plan view of the cleaning tool in accordance with FIG. 4.

An exemplary embodiment of a floor cleaning machine which is shown schematically in FIG. 1 and referenced 10 therein is a mobile floor cleaning machine. The floor cleaning machine 10 shown in FIG. 1 is a walk-behind floor cleaning machine and is in the form of a scrubbing machine for example.

It comprises a chassis 12 on which two rear wheels 14 that are rotatable about a common rotational axis are held. Furthermore, there is a steerable front wheel which is not visible in FIG. 1

The chassis 12 holds a tank 16 for a cleaning fluid as well as a tank 18 for dirty fluids. The tank 18 projects into the tank 16 at the upper end in the exemplary embodiment.

A cleaning tool 22 which faces the substrate 20 upon which the floor cleaning machine 10 stands is arranged on the chassis 12. In particular, the cleaning tool 22 is disk-shaped and is in the form of a rotary brush for example. The cleaning tool is held on the floor cleaning machine 10 by means of a tool holding head 24. The tool holding head 24 is coupled by a drive shaft 26 to a drive motor 28. The drive motor 28 propels the drive shaft 26, upon which the tool holding head 24 is seated in mutually non-rotatable manner, such that it effects a rotary movement about a rotational axis 30. Thereby, the rotational axis 30 is oriented transversely and at least approximately perpendicularly to the substrate 20.

The drive motor 28 is arranged in the interior space of the floor cleaning machine 10 wherein it is protected.

The cleaning tool 22 is held on the tool holding head 24 in releasable manner. In one exemplary embodiment, there is provided a release mechanism which is operable by a user and by means of which the cleaning tool 22 is separable from the tool holding head 24 in the axial direction. The release mechanism is operable by the user by means of a foot pedal 32 for example. In this connection, reference is made to WO 2007/033719 A1, the entire content of which is incorporated herein.

Provision may be made for the tool holding head 24 to be adjustable relative to the substrate 20 in the vertical direction 34 and in particular, to be lowerable for the purposes of facilitating the process of changing the cleaning tool.

A cleaning tool 22 can then be positioned on the substrate 20 and the tool holding head 24 can be advanced onto the cleaning tool 22 in order to fix it.

The height variability in the height direction 34 can be achieved in that the combination of the drive motor 28, the drive shaft 26 and the tool holding head 24 is displaced as a whole. For this purpose, an appropriate height adjusting device 36 is provided on the floor cleaning machine 10.

It is also possible for example, for only the drive shaft 26 and the tool holding tool 24 affixed thereto to be displaceable in the height direction 34.

The cleaning tool 22 comprises a disk-shaped supporting part 38 on which a cleaning-action device 40 is fixed (FIGS. 2 to 5).

In this example of a brush tool, the cleaning-action device 40 comprises a plurality of bristles 42 which are fixed to a plate 44. The plate 44 with the bristles 42 is in turn fixed to the supporting part 38.

In one exemplary embodiment, there are provided bristles 46*a* which are arranged in the form of a ring and they are arranged substantially perpendicularly to the plate 44. The bristles 46*a* are surrounded by a crown 48 of bristles 46*b*, wherein the bristles 46*b* are likewise arranged in the form of a ring and are oriented at an acute angle to the plate 44.

The supporting part 38 has a seating 50 for the tool holding head 24. The seating 50 comprises a wall 52 which bounds a seating space 54. The wall 52 is in the form of a ring. At the outer side thereof, there is arranged a flange 56 which is in the form of an annulus. Thereby, the wall 52 has a cylindrical outer surface 58 which rises above the flange 56 in an axial direction 59.

The flange 56 serves for fixing the plate 44 of the cleaning-action device 40.

The seating space 54 comprises a first region 60*a* and a second region 60*b*. The first region serves for fixing the tool holding head 24 in mutually non-rotatable manner. The second region 60*b* serves for facilitating the insertion of the tool holding head 24 into the first region 60*a*.

For the purposes of forming the first region 60*a*, the wall 52 comprises a holding region 62. In the holding region 62 and with regard to an envelope thereof, the wall 52 is in the form of a (hollow) cylinder and the cylinder axis thereof is parallel to the axial direction 59.

An insertion region 64 which defines the second region 60*b* follows the holding region 62 of the wall 52 in the axial direction 59 away from the bristles 42. During the process of inserting the tool head 24 in an insertion direction 66 (FIG. 4), the tool holding head 24 must initially pass through the second region 60*b* incorporating the insertion region 64 of the wall 52 so that it can enter the first region 60*a* incorporating the holding region 62 of the wall 52.

For the purposes of facilitating the insertion process, the wall 52 tapers in the insertion region 64 towards the holding region 62 and in particular, tapers continuously towards the holding region 62. In the insertion region 64 thereof, the seating space 54 is of greater diameter than in the holding region 62, wherein the diameter of the seating space 54 is constant in the holding region 62 whilst the diameter in the insertion region 64 decreases from an upper end 68 of the wall 52 down to the holding region 62.

With regard to an envelope thereof, the insertion region 64 is in the form of a (hollow) frustum of a cone. The insertion region 64 forms a sort of insertion funnel for the tool holding head 24.

A wall region of the wall 52 in the insertion region 64 is at an obtuse angle 70 (FIG. 3) to a wall region of the wall 52 in the insertion region 64. This obtuse angle lies, in particular, in a range of between 120° and 160° and is approx. 150° for example.

The wall region of the wall 52 at the insertion region 64 lies at an acute angle to the axial direction 59. This acute angle lies in particular in a range between 20° and 40° and is approx. 30° for example.

Spaced ribs 72 projecting into the seating space 54 are arranged on the wall 52. Thereby, the ribs 72 extend in the axial direction 59 and are spaced from each other in a circumferential direction, wherein they project in a radial direction into the seating space 54.

A space 73 is formed between neighboring ribs 72.

A rib 72 is arranged in the holding region 62 and projects into the insertion region 64. Hereby, a rib 72 comprises an upper surface 74, wherein the upper surface 74 of the rib 72 is inclined with respect to the axial direction 59. The upper surface 74 of a rib 72 lies at an acute angle to the axial direction 59.

Figure 6:
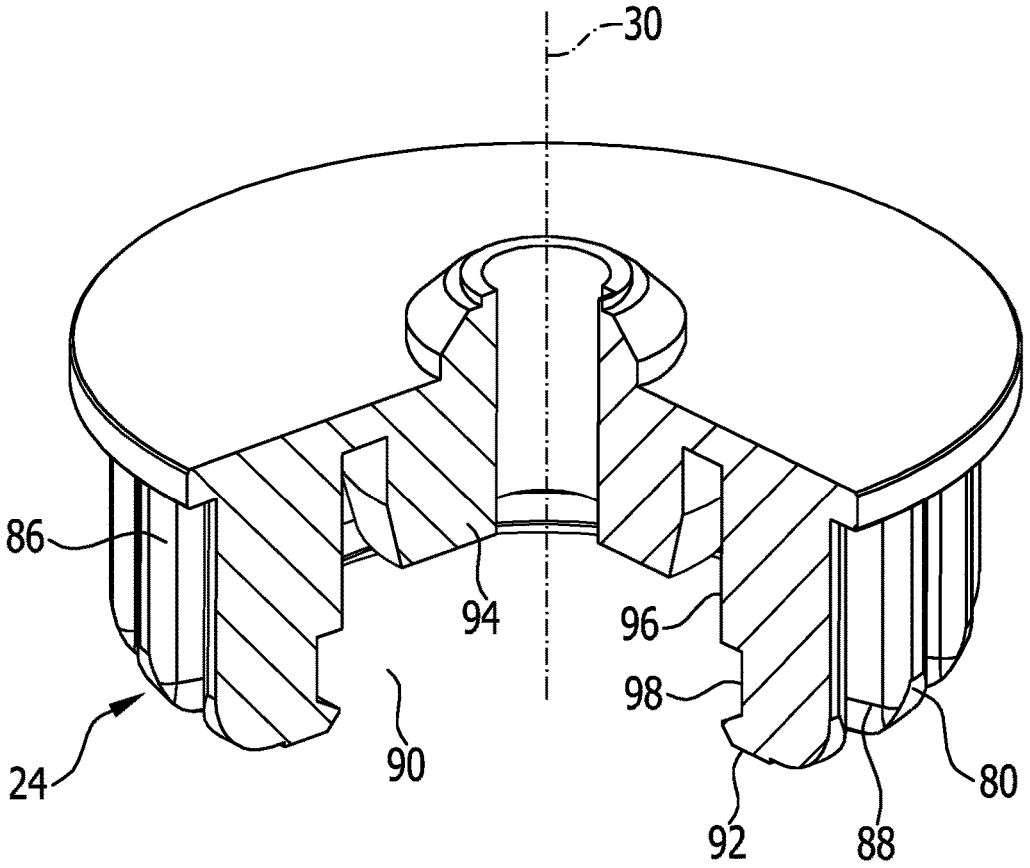
FIG. 6 shows a perspective partially sectional illustration of an exemplary embodiment of a tool holding head of the floor cleaning machine in accordance with FIG. 1.

A rib 72 comprises a tapering region 76 in the circumferential direction. The width of a particular rib 72 relative to a neighboring rib decreases in this tapering region 76, wherein the direction of the decrease is oriented in the axial direction 59. A sloping surface 78 is formed on the tapering region 76 of each of the ribs 72. This sloping surface 78 is a wedge-shaped surface which facilitates the introduction of a mating element 80 (FIG. 6) of the tool holding head 24 into the corresponding space 73 between neighboring ribs. A ring-like locating element 82 which serves to locate the tool holding head 24 in the axial direction 59 during the process of inserting it into the holding region 62 is arranged on the wall 52. The locating element 82 is arranged on the lower surface of the wall 52 (remote from the upper end 68). In particular, the ribs 72 project up to the locating element 82 and are connected thereto. This thus results in great rigidity.

Meshing elements 84 which are spaced in the circumferential direction and serve for the axial fixing of the tool holding head 24 to the cleaning tool 22 are arranged on the supporting part 38 and in particular on the locating element 82.

The meshing elements 84 are in the form of snap-action elements which project into the seating space 54 and are moveable due to their self-elasticity.

With regard to the envelope thereof, the tool holding head 24 (FIG. 6) has a cylindrical outer contour 86. Grooves 88, which are spaced in a circumferential direction and between which mating elements 80 are seated, are formed on this outer contour 86. When the cleaning tool 22 is fixed to the tool holding head 24, the mating elements 88 enter the corresponding spaces 73 between neighboring ribs 72. A rib 72 then enters a respective groove 88. An anti-rotation arrangement is thereby formed.

Upon rotation of the tool holding head 24 about the rotational axis 30, the cleaning tool 22 is then carried along therewith due to the interlocking action between the mating element 80 in the spaces 73 and the ribs 72 in the grooves 88.

In particular, the rotational axis 30 coincides with an axial axis which extends in the axial direction 59 when the cleaning tool 22 is fixed to the tool holding head.

The tool holding head 24 comprises an interior space 90. The interior space 90 is formed by a recess with respect to a lower surface 92. The interior space 90 is bounded by a base 94 and a ring wall 96. In the ring wall 96, there are formed recesses 98 into which an engagement head 100 of a corresponding meshing element 84 can engage and in particular can latch in order to provide for the axial fixing process in the axial direction 59 in a direction opposite to that of the insertion direction 66.

The cleaning tool 22 is fixable to the tool holding head 24 in releasable manner by the meshing elements 84.

By the application of appropriate force to the cleaning tool 22 for example, it can be detached from the tool holding head 24 using a release mechanism such as is described in WO 2007/033719 A1.

For example, the release mechanism is effective on the flange 56 from an upper surface thereof by means of one or more pressure elements in order to enable the engagement of the meshing elements 84 in the recesses 98 to be released.

The cleaning tool in accordance with the invention in combination with the tool holding head 24 of the floor cleaning machine 10 functions as follows.

The seating space 54 is of greater diameter in the insertion region 64 than in the holding region 62. Consequently, the process of inserting the tool holding head 24 into the seating space 54 is facilitated and a more rapid and simplified process for changing the tool on the floor cleaning machine 10 can be carried out.

For the purposes of changing a tool for example, the supporting part 38 of the cleaning tool 22 is laid on the substrate 20 underneath the tool holding head 24. The tool holding head is then moved downwardly by means of the height adjusting device 36, i.e. it is moved towards the substrate 20 in the height direction 34 so that it can enter the seating space 54.

A sort of insertion funnel is formed by the second region 60*b* incorporating the insertion region 64 so that this results in a greater amount of play for the process of insertion into the seating space 54 thereby facilitating the insertion process.

The introduction of the mating elements 80 into the corresponding spaces 73 between neighboring ribs 72 is facilitated by virtue of the tapering regions 76 of the ribs 72 and the upper surfaces 74 of the ribs 72.

The tool holding head 24 is inserted until such time as it rests on the locating element 82.

Engagement of the engagement heads 100 of the meshing elements 84 in the corresponding recesses 98 then also takes place. A latching process in the axial direction 59 thereby occurs.

An anti-rotation effect is realized due to the insertion of the mating elements 80 into the spaces 73 between the neighboring ribs 72 so that the cleaning tool 22 is driven by the rotation of the tool holding head 24.

Subsequently, the cleaning tool 22 is lifted from the substrate 20 to such an extent that its cleaning position is reached. In particular thereby, a lower surface of the cleaning tool 22 is oriented at an acute angle to the substrate 20.

In order to release the cleaning tool 22, the releasing device is operated appropriately as described in WO 2007/033719 A1.

Due to the solution in accordance with the invention, one obtains rapid and simple replacement of a tool.

In particular, the supporting part 38 is formed in one piece manner. It can be constructed in a simple manner so as to be mechanically rigid.

REFERENCE SYMBOLS LIST

10 floor cleaning machine
12 chassis
14 rear wheel
16 tank
18 tank
20 substrate
22 cleaning tool
24 tool holding head
26 drive shaft
28 drive motor
30 rotational axis
32 foot pedal
34 height direction
36 height adjusting device
38 supporting part
40 cleaning-action device
42 bristle
44 plate
46*a* bristle
46*b* bristle
48 crown
50 seating
52 wall
54 seating space
56 flange
58 outer surface
59 axial direction
60*a* first region
60*b* second region
62 holding region
64 insertion region
66 insertion direction
68 upper end
70 obtuse angle
72 rib

73 space
74 upper surface
76 tapering region
78 sloping surface
80 mating element
82 locating element
84 meshing element
86 outer contour
88 grooves
92 interior space
94 lower surface
96 floor
98 ring wall
98 recess
100 engagement head

The invention claimed is:

1. A cleaning tool for a floor cleaning machine comprising:

a cleaning-action device and a supporting part on which the cleaning-action device is arranged;

wherein the cleaning tool is fixable to the floor cleaning machine via the supporting part;

wherein the supporting part comprises a seating having a wall and a seating space for a tool holding head of the floor cleaning machine which is bounded by the wall, and the wall comprises a holding region for the tool holding head;

wherein the wall comprises an insertion region for the tool holding head to which the holding region is adjoined; and wherein the seating space is widened in the insertion region in comparison with the holding region and tapers towards the holding region.

2. The cleaning tool in accordance with claim 1, wherein the seating space tapers continuously in the insertion region in a direction towards the holding region.

3. The cleaning tool in accordance with claim 1, wherein the seating space is of greater diameter in the insertion region than in the holding region.

4. The cleaning tool in accordance with claim 1, wherein the insertion region is arranged in the seating space before the holding region taken with reference to an insertion direction of the tool holding head.

5. The cleaning tool in accordance with any claim 1, wherein a wall region which defines the insertion region is oriented at an obtuse angle to a wall region which defines the holding region.

6. The cleaning tool in accordance with claim 5, wherein the obtuse angle lies in a range of between 120° and 160°.

7. The cleaning tool in accordance with claim 1, wherein, with regard to an envelope thereof, an inner surface of the holding region facing the seating space is cylindrical.

8. The cleaning tool in accordance with claim 1, wherein, with regard to an envelope thereof, an inner surface of the insertion region facing the seating space is in the form of a frustum of a cone.

9. The cleaning tool in accordance with claim 1, wherein the wall is in the form of a ring.

10. The cleaning tool in accordance with claim 1, wherein the wall has a cylindrical outer surface.

11. The cleaning tool in accordance with claim 1, wherein the supporting part extends in an axial direction with an axial axis which coincides with a rotational axis of the cleaning tool.

12. The cleaning tool in accordance with claim 1, wherein one or more sub-regions of the wall protrude beyond a flange.

13. The cleaning tool in accordance with claim 1, wherein a plurality of spaced ribs are arranged on an inner surface of the wall at least in the holding region, wherein a mating element of the tool holding head is insertable into a space between spaced ribs.

14. The cleaning tool in accordance with claim 13, wherein the ribs are oriented in an axial direction and are spaced in a circumferential direction.

15. The cleaning tool in accordance with claim 13, wherein the ribs have an upper surface which is oriented at an acute angle to an axial direction.

16. The cleaning tool in accordance with claim 15, wherein the upper surface is arranged at least partly in the insertion region.

17. The cleaning tool in accordance with claim 13, wherein a rib comprises a tapering region towards a spaced rib in which a width of the rib in the direction of spacing from the neighboring rib reduces in a direction towards the insertion region.

18. The cleaning tool in accordance with claim 17, wherein a sloping surface serving as an insertion aid for a mating element of the tool holding head is formed in the tapering region.

19. The cleaning tool in accordance with claim 1, wherein a locating element for the tool holding head in an axial direction is arranged on the supporting part.

20. The cleaning tool in accordance with claim 1, wherein at least one meshing element for the tool holding head is arranged on the supporting part for axial fixing purposes.

21. The cleaning tool in accordance with claim 20, wherein the at least one meshing element is arranged on a locating element for the tool holding head.

22. The cleaning tool in accordance with claim 20, wherein the at least one meshing element is seated on the supporting part in moveable manner and is latchable to the tool holding head.

23. The cleaning tool in accordance with claim 1, wherein the supporting part is formed in one piece manner.

24. The cleaning tool in accordance with claim 1, said cleaning tool being in the form of a brushing tool.

25. A floor cleaning machine comprising at least one tool holding head to which a cleaning tool is fixable or is fixed in releasable manner, said cleaning tool comprising:

a cleaning-action device and a supporting part on which the cleaning-action device is arranged;

wherein the cleaning tool is fixable to the floor cleaning machine via the supporting part;

wherein the supporting part comprises a seating having a wall and a seating space for a tool holding head of the floor cleaning machine which is bounded by the wall, and the wall comprises a holding region for the tool holding head;

wherein the wall comprises an insertion region for the tool holding head to which the holding region is adjoined; and wherein the seating space is widened in the insertion region in comparison with the holding region and tapers towards the holding region.

26. The floor cleaning machine in accordance with claim 25, wherein the tool holding head is driven or is drivable in rotary manner.

27. The floor cleaning machine in accordance with claim 25, wherein the at least one tool holding head is moveable in a height direction taken with respect to a substrate on which the floor cleaning machine is placed.

28. The floor cleaning machine in accordance with claim 25, wherein the at least one tool holding head comprises a plurality of spaced grooves on an outer surface thereof, wherein a respective mating element is formed between each of the neighboring grooves, and ribs of the supporting part of the cleaning tool are insertable into the grooves and the mating element is insertable into a space between neighboring ribs of the supporting part.

29. The floor cleaning machine in accordance with claim 25, wherein the at least one tool holding head comprises at least one recess for a meshing element of the cleaning tool for the purpose of the axial fixing thereof.

* * * * *